US006361119B1

(12) United States Patent
Kussel

(10) Patent No.: US 6,361,119 B1
(45) Date of Patent: Mar. 26, 2002

(54) MINING CONTROL SYSTEM FOR ADJUSTING THE ADVANCE OF MINING TOOLS

(75) Inventor: Willy Kussel, Werne (DE)

(73) Assignee: Tiefenbach Bergbautechnik GmbH, Essen (DE)

( * ) Notice: Subject to any disclaimer, the term of this patent is extended or adjusted under 35 U.S.C. 154(b) by 0 days.

(21) Appl. No.: 09/550,870

(22) Filed: Apr. 17, 2000

(30) Foreign Application Priority Data

Apr. 17, 1999 (DE) ..... 199 17 416

(51) Int. Cl.[7] ..... E21C 35/08

(52) U.S. Cl. ..... 299/1.1; 299/1.6; 299/1.7; 405/302

(58) Field of Search ..... 299/1.05, 1.1, 299/1.4, 1.5, 1.6, 1.7; 405/302

(56) References Cited

U.S. PATENT DOCUMENTS

| | | | | |
|---|---|---|---|---|
| 3,643,445 A | | 2/1972 | Schmidt | |
| 4,155,594 A | * | 5/1979 | Hartley et al. | 299/1.1 |
| 4,228,508 A | | 10/1980 | Benthaus | |
| 4,330,154 A | * | 5/1982 | Harris | 299/1.7 |
| 5,029,943 A | * | 7/1991 | Merriman | 299/1.7 |
| 5,110,187 A | * | 5/1992 | Heintzmann et al. | 299/1.4 |
| 5,234,256 A | | 8/1993 | Demircan et al. | |

FOREIGN PATENT DOCUMENTS

| | | |
|---|---|---|
| DE | 2 303 433 A | 8/1974 |
| DE | 31 14305 A1 | 11/1982 |
| DE | 42 02 246 A1 | 8/1992 |
| DE | 195 46 427 A1 | 8/1996 |
| GB | 2 254 640 A | 10/1992 |
| GB | 2 265 652 A | 10/1993 |

* cited by examiner

*Primary Examiner*—David Bagnell
*Assistant Examiner*—Daniel P Stephenson
(74) *Attorney, Agent, or Firm*—Alston & Bird LLP

(57) ABSTRACT

A mining control system for adjusting the advance of the working tools of a mining machine with respect to working depth and/or working height connects to a detection device that is for recognizing the rock being mined and is carried along by the mining machine. A central command station connects by radio to the detection device of the mining machine. The mining control system comprises a plurality of radio receivers arranged in spaced relationship along the longwall, as well as a comparator, which is used for comparing the intensity of the radio signals received by the individual radio receivers and for retransmitting only the strongest of the radio signals to the central command station for generating the command signals for controlling the advance of the mining tools. It is also possible to transmit the radio signals received by each radio receiver to adjacent radio receivers. A separate comparator is associated to and controls each radio receiver. A radio receiver is allowed to transmit data to the command station only when the signals received by it are stronger than the radio signals received by the other radio receivers.

2 Claims, 2 Drawing Sheets

MINING CONTROL SYSTEM FOR ADJUSTING THE ADVANCE OF MINING TOOLS

BACKGROUND OF THE INVENTION

The present invention relates to a mining control system for adjusting the advance of the mining tools of a cutting machine for mining coal or other minerals and, more particularly, to the advance of the mining tools of a longwall mining machine of the type disclosed in U.S. Pat. No. 5,234,256.

A mining control system of this kind can experience problems with data transmission, concerning determined rock data, to the central command station, which controls the advance of the mining machine. In this connection, it is also necessary to take into account data transmission by radio, which is problematic in mining due to difficult transmitting conditions on the one hand and high safety requirements on the other. In particular, it is important for the decreased intensity of the radio signals caused by the distance of the mining machine from the receiving radio receiver not to be mistaken for a fluctuation of the measured quantity.

This risk of error is intensified by the difficult conditions in underground mining. This results again in hazards for the safe support of the longwall by incorrect readouts and wrong controls.

It is accordingly an object of the present invention to avoid these disadvantages and to equip a control system such that it operates free of wear and trouble and yet is robust and reliable.

SUMMARY OF THE INVENTION

The present invention solves the above and other problems by providing an improved control system for adjusting the advance of working tools of a mining machine, such as a mining machine of the type in which the working tools advance along and remove rock (e.g. coal) from a longwall. In accordance with the present invention, only the strongest of the radio signals that provide information about the rock being removed from the longwall is used for commanding the advance.

In accordance with one aspect of the present invention, the control system includes at least one detection device proximate the working tools of the mining machine. The detection device is operative for sensing characteristics of the rock to be removed from the longwall. The detection device is also operative for transmitting a radio signal that provides data representative of the characteristics of the rock to be removed. The control system also includes multiple radio receivers. Each of the radio receivers is operative for receiving the radio signal transmitted by the detection device. Additionally, the radio receivers are arranged in spaced relationship along the longwall such that the intensities of the radio signals received by the radio receivers vary from radio receiver to radio receiver. A comparator system of the control system is operative for comparing the intensities of the radio signals received by the radio receivers. The comparitor retransmits the one of those radio signals having the greatest intensity. A command station is operative for receiving the retransmitted radio signal. The command station generates command signals that are based upon the retransmitted radio signal, and the command signals control the advancing of the working tools.

In accordance with another aspect of the present invention, each of the radio receivers is associated with a respective comparitor that is operative for comparing the intensities of the radio signals received by the radio receivers. The comparitors are operative so that only the radio receiver receiving the most intense radio signal from the detection device retransmits data to the command station.

BRIEF DESCRIPTION OF THE DRAWINGS

In the following, an embodiment of the invention is described with reference to the drawings, in which.

DETAILED DESCRIPTION OF AN EMBODIMENT OF THE INVENTION

Figure 1:
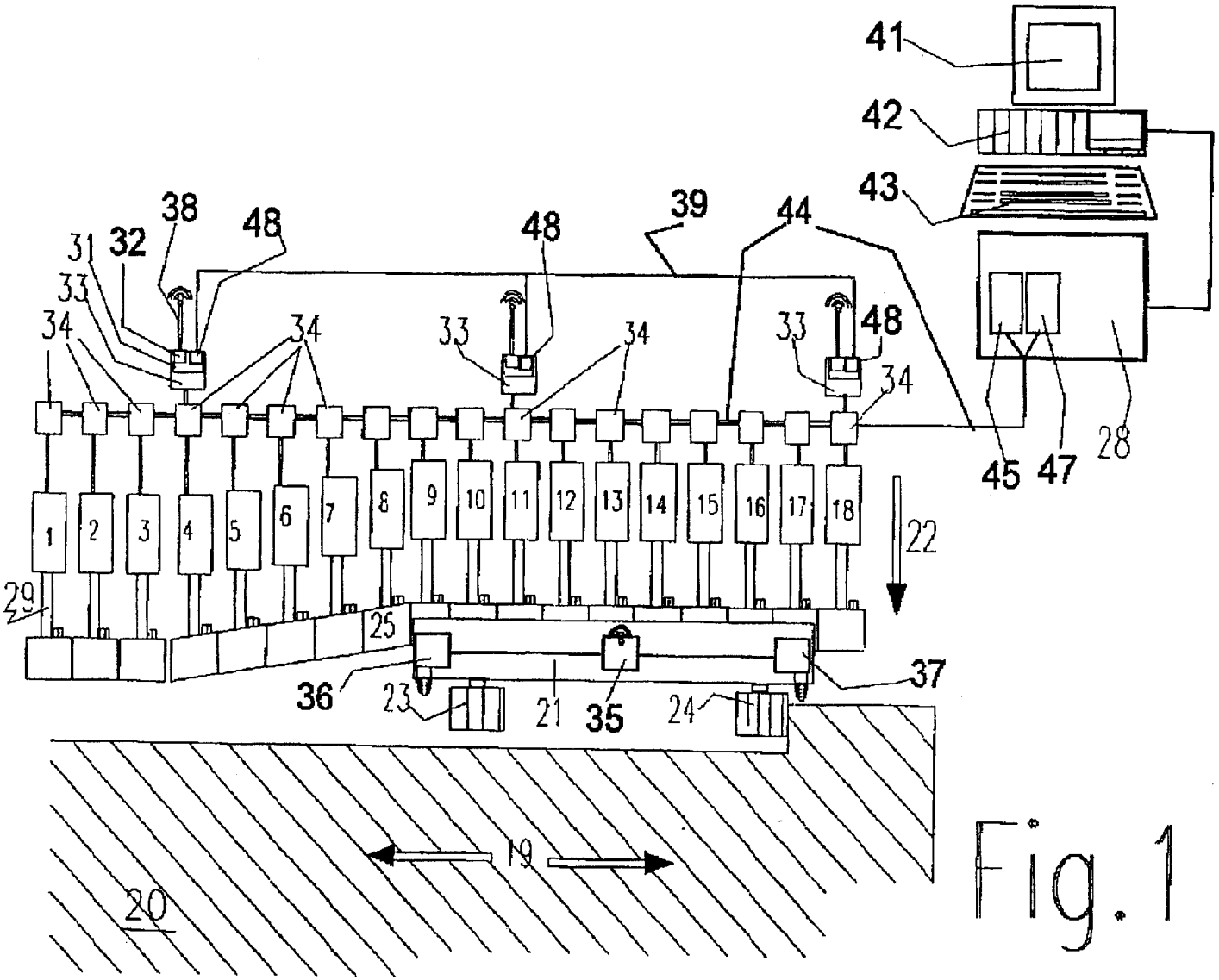
FIG. 1 is primarily a schematic top view of a coal cutting machine.
Figure 2:
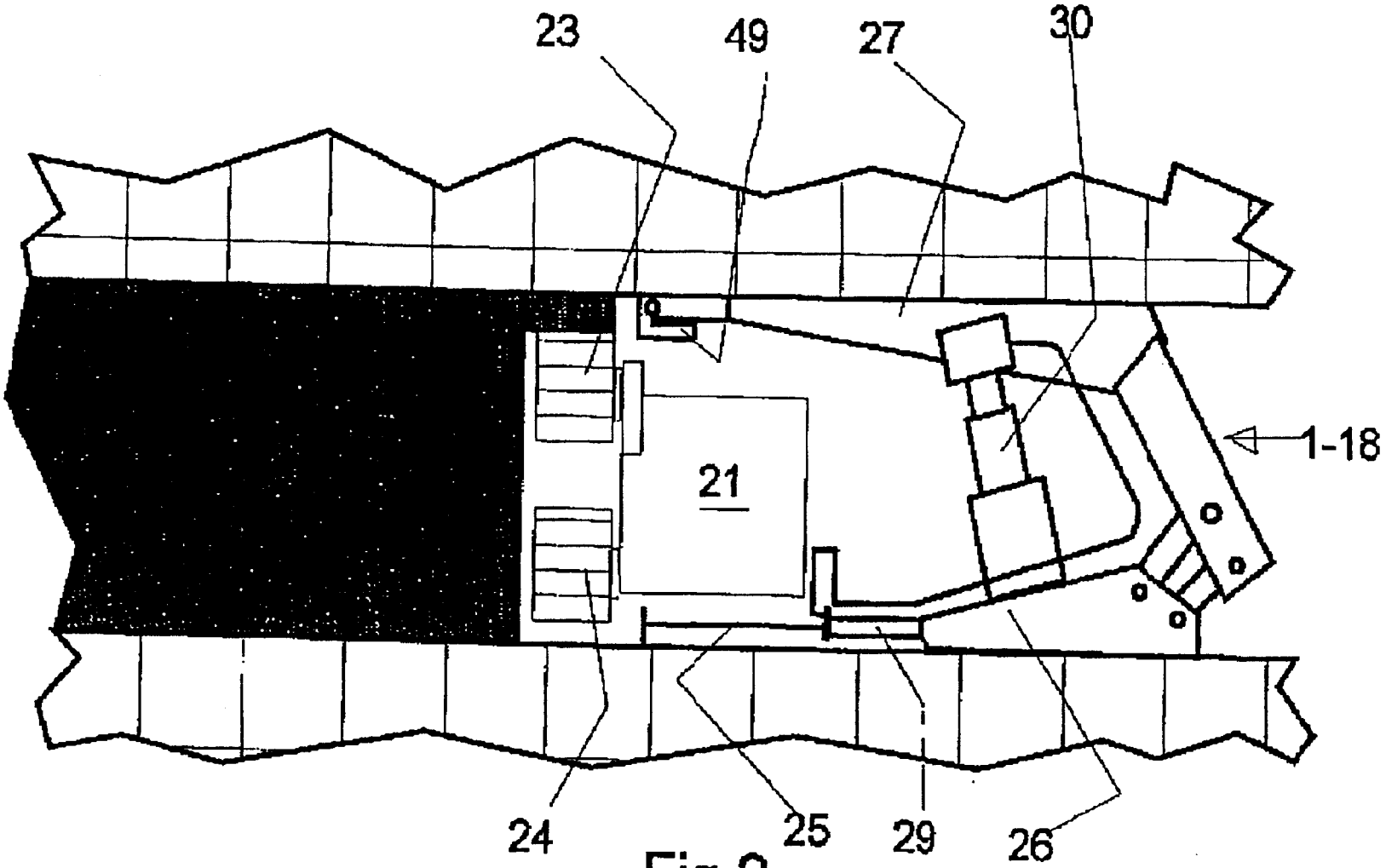
FIG. 2 is a sectional view of a longwall and schematically illustrates portions of the coal cutting machine.

FIG. 1 illustrates longwall support units 1–18. These support units are arranged along a coal bed 20. The coal bed 20 (e.g. rock) is mined in a working direction 22 by cutting devices 23, 24 of a mining machine that is in the form of a coal cutting machine 21. The coal cutting machine 21 is movable in a cutting direction 19 by means of a cable (not shown). It comprises two cutting rolls 23, 24, whose height and advance in the working direction 22 are adjustable by a central command station. The coal that has become dislodged by shearing the longwall is loaded onto a conveyor 25 by means of the coal cutting machine, also named "cutter-loader." The conveyor 25 consists of a channel, in which an armored conveyor is moved along the coal face. The channel is subdivided into individual units that are interconnected and are capable of performing a movement relative to one another in the working direction 22. Each of the units connects by means of a cylinder-piston unit (advance piston 29) to one of the longwall support units 1–18. Each of the longwall support units serves the purpose of supporting the longwall. To this end, a further cylinder-piston unit 30 is used, which stays a base plate 26 relative a roof plate 27. At its front end facing the coal bed, the roof plate mounts a so-called coal face catcher 49. This catcher is a flap that can be lowered in front of the mined coal face. It is necessary to raise the coal face catcher ahead of the approaching coal cutting machine 21. Likewise to this end, a further cylinder-piston unit (not shown) is used.

In FIG. 1, the coal cutting machine 21 moves to the right. For this reason, the coal face catcher of longwall support unit 17 must be folded back. On the other hand, the channel of the longwall support unit 9, which is behind the coal cutting machine, advances in the direction toward the mined coal face. Likewise, the following longwall support units 8, 7, 6, 5, and 4 are in the process of advancing toward the longwall or mined coal face. On these support units, the coal face catcher has already been lowered again. The support units 3, 2, 1 have completed their advance, and remain in their position, until the coal cutting machine approaches again from the right.

As a function of the movements of the coal cutting machine, the control of the movements occurs in part automatically, and in part manually. To this end, each longwall support is associated with a mining shield control device 34, and groups of longwall supports are associated to respective ones of longwall control devices 33. Each of the mining shield control devices 34 connects to one longwall support unit. The mining shield control devices 34 are also interconnected, and they connect to a central command station 28 by means of a cable 44. The automatic release of functions and operational sequences is described, for example, in DE-A1 195 46 427.3, and the manual operation is described, for example, in DE 199 17 112.2, which corresponds to U.S. application Ser. No. 09/550,326.

The central command station (central computer) 28 comprises a central processing unit (CPU) 45 for the longwall support control and a further central processing unit (CPU) 47 for the data of the mining control. The central command station 28 connects to or also includes a computer 42 that is connected to a display screen 41 and a keyboard 43. The central command station 28 also connects via the line 44 to the units of the mining shield control 34 and the longwall support control 33. Each mining shield control unit is associated with a respective radio device 32 with microprocessor 31, comparator 48, and antenna 38.

The mining machine, which is here shown as a coal cutting machine 21 with cutting rolls 23, 24, comprises rock sensors 36, 37, which are capable of recognizing rock types and rock hardness, as well as other characteristics. For processing the rock data and transmitting the data to the central command station 28, the rock sensors connect to microprocessors and a transmitter 35, which is arranged on the mining machine. The transmitter 35 transmits the data via radio signals that are received by the radio receivers 32 of the longwall support control devices 33. Since the longwall has a great length, the radio receivers 32 receive radio signals of different intensity. A line 39 interconnects the radio receivers 32 for transmitting the received radio signals therebetween. These radio signals are compared with one another in each radio receiver 32 by means of the integrated microprocessors 31 and comparators 48. For each radio receiver 32, its microprocessor 31 is programmed such that it blocks the connection between the radio receiver and the longwall support control device 34 and central command station 28 via line (longwall cable) 44 as long as the radio signal received by the radio receiver 32 does not have the greatest intensity as compared to the radio signals received by all of the other radio receivers 32. This ensures that always the clearest signal is used for a command output, and avoids mistaking fluctuating intensity of the radio signals for meaningful information. To this end, the microprocessors are equipped such that they always transmit in the same format to the central commmand station 28 the data that are received and retransmitted based on the comparison.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A control system for adjusting the advance of working tools of a mining machine with respect to working depth or working height as a function of the nature of the rock as the working tools advance along and remove the rock from a wall, the control system comprising:

a detection device proximate the working tools of the mining machine for sensing characteristics of the rock of the wall and transmitting a radio signal that provides data representative of the characteristics of the rock;

a plurality of radio receivers, with each of the radio receivers receiving the radio signal transmitted by the detection device, wherein the radio receivers are arranged in spaced relationship along the length of the wall such that the intensities of the radio signals received by the radio receivers vary from radio receiver to radio receiver;

a comparator system for comparing the intensities of the radio signals received by the radio receivers and retransmitting the one of those radio signals having the greatest intensity; and a command station operative for receiving the retransmitted radio signal and generating command signals that are based upon the retransmitted radio signal for the advance of the working tools.

2. A control system as defined in claim 1, wherein the comparator system comprises a plurality of comparators, with each comparator operatively associated with a respective radio receiver, and a line interconnecting each of the radio receivers to all of the comparators, wherein each of the comparators compares the radio signals received by the radio receivers and blocks the retransmission from the associated radio receiver as long as the radio signal received by the associated radio receiver does not have the greatest intensity of all radio receivers.

* * * * *